US006682001B2

(12) United States Patent
Diana

(10) Patent No.: US 6,682,001 B2
(45) Date of Patent: Jan. 27, 2004

(54) MODULAR COLOR CHANGER

(75) Inventor: Michael J. Diana, Orion, MI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/175,362

(22) Filed: Jun. 19, 2002

(65) Prior Publication Data

US 2003/0234300 A1 Dec. 25, 2003

(51) Int. Cl.[7] ..... A62C 31/00; E03B 9/02; E03B 00/00; F17D 1/00; A16K 15/00

(52) U.S. Cl. ..... 239/305; 137/560; 137/884

(58) Field of Search ..... 239/104, 106, 239/110, 112, 113, 124, 125, 298, 305, 548, 549, 550; 118/302, 313; 137/560, 884

(56) References Cited

U.S. PATENT DOCUMENTS

| | | | | |
|---|---|---|---|---|
| 2,583,664 | A | | 1/1952 | Oldham et al. |
| 2,806,481 | A | | 9/1957 | Faust |
| 3,045,691 | A | | 7/1962 | Young |
| 3,053,461 | A | | 9/1962 | Inglis |
| 3,150,675 | A | | 9/1964 | Phillips |
| 3,326,228 | A | | 6/1967 | Phillips |
| 3,433,262 | A | | 3/1969 | Ray |
| 3,828,807 | A | | 8/1974 | Dawes |
| 4,148,932 | A | | 4/1979 | Tada et al. |
| 4,159,806 | A | | 7/1979 | Scharfenberger |
| 4,311,724 | A | | 1/1982 | Scharfenberger |
| 4,348,425 | A | | 9/1982 | Scharfenberger |
| 4,350,720 | A | | 9/1982 | Scharfenberger |
| 4,356,868 | A | | 11/1982 | Bentley et al. |
| 4,362,124 | A | | 12/1982 | Fleig |
| 4,403,736 | A | | 9/1983 | Scharfenberger |
| RE32,151 | E | | 5/1986 | Scharfenberger |
| 4,592,305 | A | | 6/1986 | Scharfenberger |
| 4,627,465 | A | * | 12/1986 | Kolibas et al. ..... 137/563 |
| 4,660,597 | A | | 4/1987 | Cowles |
| 4,828,218 | A | | 5/1989 | Medlock |
| 5,058,812 | A | | 10/1991 | Cox et al. |

(List continued on next page.)

FOREIGN PATENT DOCUMENTS

| | | |
|---|---|---|
| DE | 41 33 840 | 4/1993 |
| DE | 43 42 128 | 6/1995 |
| DE | 19729051 | 1/1999 |
| DE | 198 16 041 | 10/1999 |
| DE | 198 19 339 | 12/1999 |
| DE | 199 37 426 | 3/2001 |
| DE | 10006310 | 8/2001 |
| JP | 10107753 | 4/1998 |

OTHER PUBLICATIONS

MCV Series Modular Color Changer, Model(s) 78011–XX, , Service Manual, CS–01–01, ITW Ransburg, Copyright 2001.*

"If you don't have one already, you would do well to consider a pigging program implemented on a regular basis", John Nehrbass, Flow Control, Oct., 2001, vol. VII, No. 10, pp. 34–38.

*Primary Examiner*—Kevin Shaver
*Assistant Examiner*—Anuradha Ramana
(74) *Attorney, Agent, or Firm*—Lisa M. Sotis; Mark W. Croll; Donald J. Breh

(57) ABSTRACT

A coating material color changer includes multiple modules. Each module includes a body constructed from an electrically non-conductive material, such as an insulative resin or polymer, and a plate coupled to the body and constructed from, for example, stainless steel. Each plate includes at least one of a receptacle for receiving an electrically non-insulative contact and an electrically non-insulative contact oriented to be received in such a receptacle when multiple modules are coupled together in a coating material color changer to couple the plates of the modules of the coating material color changer together electrically.

26 Claims, 3 Drawing Sheets

U.S. PATENT DOCUMENTS 5,102,046 A * 4/1992 Diana ..... 239/3
5,197,676 A * 3/1993 Konieczynski et al. ..... 239/690
5,318,065 A 6/1994 Edwards et al.
5,632,816 A 5/1997 Allen et al.
5,647,542 A * 7/1997 Diana ..... 239/690
5,725,150 A 3/1998 Allen et al.
5,913,637 A 6/1999 Rajabali et al.
6,037,010 A 3/2000 Kahmann et al.
6,090,450 A 7/2000 Kahmann et al.
2001/0013315 A1 8/2001 Klein et al.
2002/0139301 A1 * 10/2002 Attinoto et al. ..... 118/308

* cited by examiner

MODULAR COLOR CHANGER

FIELD OF THE INVENTION

This invention relates to fluid source changers or fluid type changers for fluid circuits. It is disclosed in the context of a color changer for a coating material dispensing system. However, it is believed to be useful in other applications as well.

BACKGROUND OF THE INVENTION

As used herein, the term "electrically non-conductive" means electrically more insulative than the term "electrically conductive." The term "electrically noninsulative" means electrically more conductive than the term "electrically insulative."

Fluid source changers or fluid type changers, for example, fluid color changers, and related components for various applications are known. There are, for example, the devices and systems illustrated and described in the following U.S. Patents, and references cited in these U.S. Pat. Nos. 2,583,664; 2,806,481; 3,045,691; 3,053,461; 3,150,675; 3,326,228; 3,433,262; 3,828,807; 4,148,932; 4,159,806; 4,311,724; 4,348,425; 4,350,720; 4,356,868; 4,362,124; 4,403,736; 4,592,305; 4,660,597; 4,828,218; 5,058,812; 5,318,065; 5,632,816; 5,725,150; and, Re. 32,151. There are also the devices and systems illustrated and described in U.S. Ser. No. 10/022,494, filed Dec. 17, 2001, titled IMPROVEMENTS IN COLOR CHANGERS and assigned to the same assignee as this application, and the references cited therein; and U.S. Ser. No. 10/021,467, filed Oct. 30, 2001, titled MODULAR FLUID PRESSURE REGULATOR WITH BYPASS and assigned to the same assignee as this application, and the references cited therein. The disclosures of all of these references are hereby incorporated herein by reference. No representation is intended by this listing that a complete search of all the relevant prior art has been conducted, or that no better art than that listed is available, or that the listed art is relevant. Nor should any such representation be inferred.

DISCLOSURE OF THE INVENTION

According to one aspect of the invention, a fluid type changer includes multiple modules. Each module includes a body constructed from an electrically non-conductive material and a plate coupled to the body and constructed from an electrically non-insulative material. Each plate includes at least one of a receptacle for receiving an electrically non-insulative contact and an electrically non-insulative contact oriented to be received in such a receptacle when multiple modules are coupled together in a fluid type changer to couple the plates of the modules of the fluid type changer together electrically.

Illustratively according to this aspect of the invention, at least one of the modules includes a valve for selecting a fluid provided to that module for supply from the changer to equipment coupled to the changer.

Further illustratively according to this aspect of the invention, each plate includes a surface for orienting adjacent an adjacent surface of an adjacent plate. One of the adjacent surfaces includes at least one of the contacts and the other of the adjacent surfaces includes at least one of the receptacles for receiving the said one of the contacts.

Additionally illustratively according to this aspect of the invention, each of the adjacent surfaces includes both at least one of the contacts and at least one of the receptacles.

Further illustratively according to this aspect of the invention, the apparatus includes a source for the selected fluid for coupling in a circuit with the at least one module. The at least one module includes an input port for entry into the at least one module of the selected fluid from the source and a recirculation port for the recirculation of the selected fluid from the at least one module back to the source.

Further illustratively according to this aspect of the invention, the apparatus includes an electrically non-insulative coupler for coupling the source of the selected fluid to the input port and an electrically non-insulative coupler for coupling the recirculation port to the source of the selected fluid. The couplers are electrically coupled to the plate on the at least one module.

Illustratively according to this aspect of the invention, the module includes an output port for the output of the selected fluid from the fluid type changer, selection of the valve permitting the selected fluid to flow from the input port to the output port.

Further illustratively according to this aspect of the invention, the apparatus includes a plurality of sources for respective selected fluids, a plurality of the modules including respective input ports for entry into the respective modules of respective fluids from respective sources and respective recirculation ports for the recirculation of the respective fluids from the respective modules back to the respective sources.

Further illustratively according to this aspect of the invention, the apparatus includes electrically non-insulative couplers for coupling respective sources to respective input ports and electrically non-insulative couplers for coupling respective recirculation ports to respective sources. The couplers are electrically coupled to the plates on the respective modules, and electrically coupled together through the electrically non-insulative contacts and receptacles on the respective plates.

According to another aspect of the invention, a fluid type changer including a body constructed from an electrically non-conductive material and a plate constructed from an electrically non-insulative material coupled to the body, a source of fluid for coupling in a circuit with the body, the body including an input port for entry of the fluid from the source and a recirculation port for the recirculation of the fluid back to the source, an electrically non-insulative coupler for coupling the source of the fluid to the input port and an electrically non-insulative coupler for coupling the recirculation port to the source of the fluid, the couplers being electrically coupled to the plate.

Illustratively according to this aspect of the invention, the body includes a valve for controlling dispensing of the fluid from the changer to equipment coupled to the changer.

Additionally illustratively according to this aspect of the invention, the body includes an output port for the output of the fluid from the changer. Operation of the valve permits the fluid to flow from the input port to the output port.

According to yet another aspect of the invention, a fluid type changer includes multiple modules. Each module includes a body constructed from an electrically non-conductive material. Each body includes a valve for selecting a fluid provided to that module for supply from the changer to equipment coupled to the changer. Each module further includes a plate constructed from an electrically non-insulative material coupled to its respective body. Each plate includes at least one of a receptacle for receiving an electrically non-insulative contact and an electrically non-insulative contact oriented to be received in such a receptacle when multiple modules are coupled together in a fluid type changer to couple the plates of the modules of the fluid type changer together electrically.

Illustratively according to this aspect of the invention, each plate includes a surface for orienting adjacent an adjacent surface of an adjacent plate. One of the adjacent surfaces includes at least one of the contacts and the other of the adjacent surfaces includes at least one of the receptacles for receiving the said one of the contacts.

Additionally illustratively according to this aspect of the invention, each of the adjacent surfaces includes both at least one of the contacts and at least one of the receptacles.

Further illustratively according to this aspect of the invention, the apparatus includes a source for each type of fluid provided to the changer. Each respective source is coupled in circuit with a respective module. Each respective module includes an input port for entry of a respective fluid from a respective source and a recirculation port for the recirculation of the respective fluid from the respective module back to the respective source.

Further illustratively according to this aspect of the invention, the apparatus includes an electrically non-insulative coupler for coupling each source of fluid to the input port of a respective module and an electrically non-insulative coupler for coupling the recirculation port of a respective module to the respective fluid source. The couplers of each module are electrically coupled to the plate on that respective module.

Additionally illustratively according to this aspect of the invention, each module includes an output port permitting the flow of a selected fluid from the fluid type changer. The output ports of the respective modules are coupled together.

Additionally illustratively according to this aspect of the invention, the output ports of the respective modules are through ports. The through ports of the modules are aligned with each other to form a common passageway in the fluid type changer.

According to another aspect of the invention, a method is provided for maintaining components of a fluid type changer at substantially common electrical potential. The method includes providing multiple modules, each including a body constructed from an electrically non-conductive material. Each body includes a valve for selecting a fluid provided to that module for supply from the changer to equipment coupled to the changer. The method further includes providing on each module a plate constructed from an electrically non-insulative material. At least one of a receptacle for receiving an electrically non-insulative contact and an electrically non-insulative contact oriented to be received in such a receptacle is provided on each plate. The multiple modules are assembled together in a fluid type changer, coupling the plates of the modules together electrically.

Illustratively according to this aspect of the invention, providing on each module a plate constructed from an electrically non-insulative material includes providing on each plate a surface. Providing on each plate at least one of a receptacle for receiving an electrically non-insulative contact and an electrically non-insulative contact oriented to be received in such a receptacle, and assembling the multiple modules together to couple the plates of the modules together electrically together include providing on one of the adjacent surfaces at least one of the contacts and providing on the other of the adjacent surfaces at least one of the receptacles for receiving the said one of the contacts, orienting the surfaces of adjacent plates adjacent each other, and assembling the multiple modules together so that the at least one contact engages the at least one receptacle.

Additionally illustratively according to this aspect of the invention, providing on one of the adjacent surfaces at least one of the contacts and providing on the other of the adjacent surfaces at least one of the receptacles for receiving the said one of the contacts includes providing on each of the adjacent surfaces both at least one of the contacts and at least one of the receptacles.

Further illustratively according to this aspect of the invention, the method includes coupling a source for each type of fluid in circuit with an input port of a respective module and a recirculation port of said respective module, and circulating the respective fluid between the source for the respective fluid and the respective module.

Illustratively according to this aspect of the invention, coupling a source for each type of fluid in circuit with an input port of a respective module and a recirculation port of said respective module includes electrically coupling to the plate on that respective module an electrically non-insulative coupler for coupling each source of fluid to the input port of that respective module and an electrically non-insulative coupler for coupling the recirculation port of that respective module to the respective fluid source.

Additionally illustratively according to this aspect of the invention, providing multiple modules includes providing on each module an output port permitting the flow of a selected fluid from the fluid type changer. Assembling the multiple modules together in a fluid type changer includes assembling the multiple modules together with the output ports of the respective modules coupled together.

Illustratively according to this aspect of the invention, providing on each module an output port permitting the flow of a selected fluid from the fluid type changer includes providing on each module a through port permitting the flow of a selected fluid from the fluid type changer. Assembling the multiple modules together with the output ports of the respective modules coupled together includes aligning the through ports of the modules with each other to form a common passageway in the fluid type changer.

BRIEF DESCRIPTIONS OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 2:
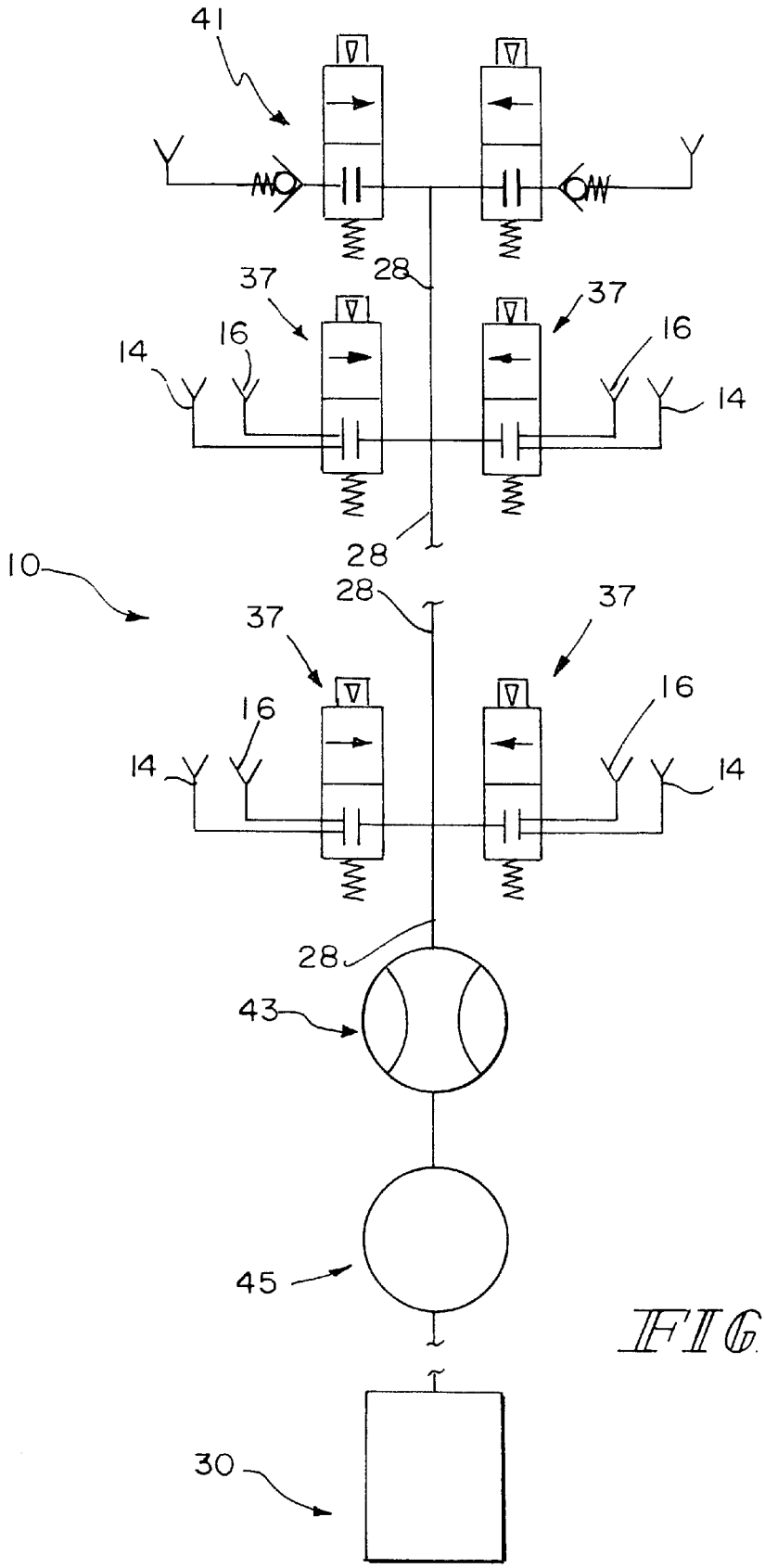
FIG. 2 illustrates a highly diagrammatic view of the color changer illustrated in FIG. 1.
Figure 3:
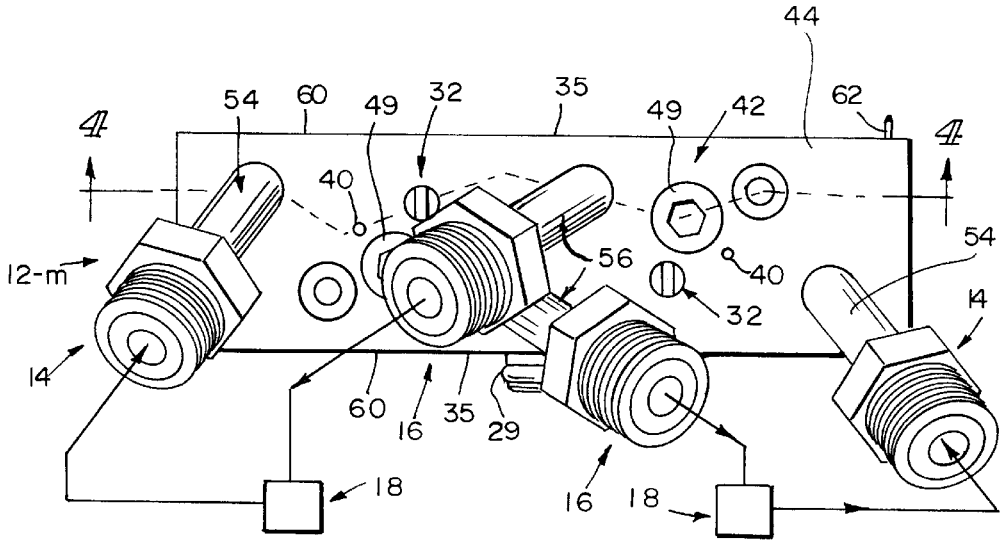
FIG. 3 illustrates a top plan view of a single, two color module of the color changer illustrated in FIGS. 1–2; and, FIG. 4 illustrates a sectional side elevational view of the module illustrated in FIG. 3, taken generally along section line 4—4 of FIG. 3.
Figure 4:
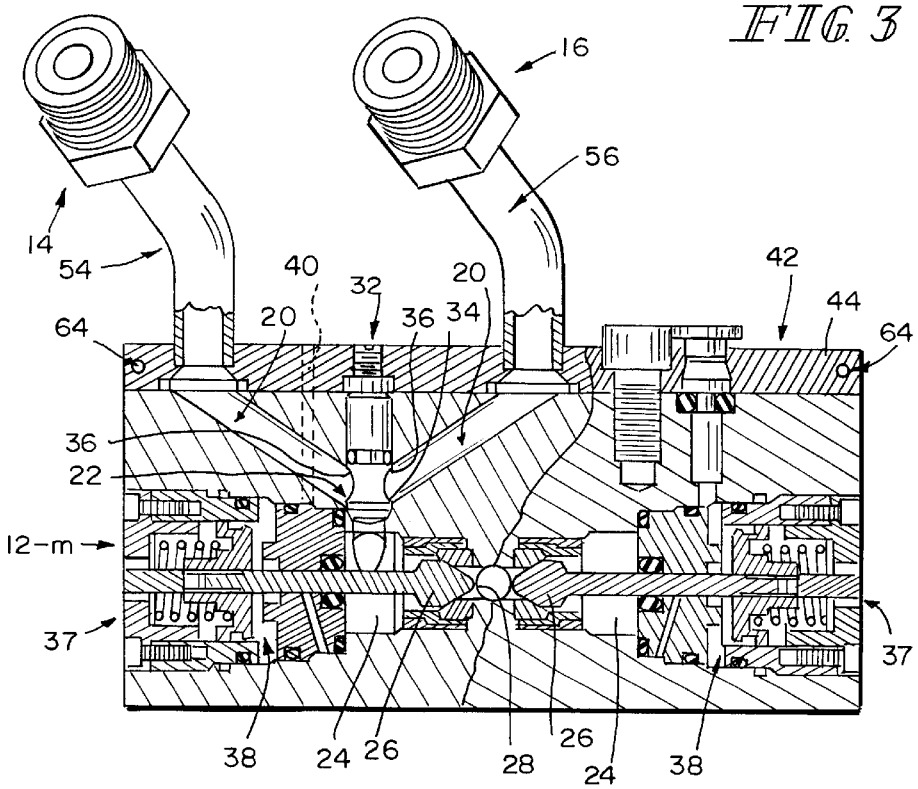

An illustrative modular liquid coating material color changer 10 constructed according to the invention includes multiple modules 12-1, 12-2, . . . 12-n, FIGS. 2–4, each of which can be, for example, a two-, four- or eight-color valve module. Each color is provided an inlet port 14 through which that color enters its respective module 12, and a recirculation port 16 through which that color exits its respective module 12 for recirculation to a source 18, FIG. 3, of that respective color. It should be noted that the inlet and recirculation ports 14, 16 can be reversed in the illustrative modular color changer 10, as will become apparent as this description proceeds. Within the module 12, a passageway 20, FIG. 4, couples the inlet and recirculation ports 14, 16.

A passageway 22 couples passageway 20 to a color selector valve chamber 24, FIG. 4. A valve member 26 moves between a valve closing position illustrated in FIG. 4, in which the color controlled by that valve member 26 is not dispensed into a main through passageway 28 of color changer 10, and a valve opening position, not shown, in which the color controlled by that valve member 26 is dispensed into the main through passageway 28 of color changer 10. In the assembled color changer 10, the main through passageways 28 of all of the modules 12-1, 12-2, . . . 12-n are coaxial, so that whatever color is selected flows through all of the through passageways 28 between the selected color's module 12-1, 12-2, . . . 12-n and the equipment 30, for example, a coating material dispenser of the general type illustrated and described in U.S. Pat. No. 4,148,932, coupled to the output of the last module 12-n in the "stack" of modules 12-1, 12-2, . . . 12-n which make up the color changer 10. Illustratively, each module 12-1, 12-2, . . . 12-n accommodates $2^k$ colors, where k is an integer, $1 \leqq k$, for example, 2, 4 or 8 colors.

Modules 12-1, 12-2, . . . 12-n are assembled into color changer 10 by aligning their passageways 28, with appropriate fittings and O-ring seals 29 between them. Then, the adjacent modules 12-1, 12-2, . . . 12-n are joined by inserting somewhat I-shaped cross section retaining clips 31, FIG. 1, into the facing slot shaped openings of T-shaped cross section channels 33 provided in facing surfaces 35 of modules 12-1, 12-2, . . . 12-n.

A manual shutoff valve 32, FIGS. 3–4, is provided at the junction of each passageway 20 and its respective passageway 22. The illustrative manual shutoff valve 32 includes a stem which is actuated, for example, by a screwdriver, to close against a seat 34 provided at the junction of passageways 20 and 22. The valve 32 includes a transverse through passageway 36 which permits fluid to continue to flow between inlet port 14 and recirculation port 16 when valve 32 is closed against seat 34. This permits the flow of coating material from passageway 20 into passageway 22 to be closed off to permit that color's respective valve member 26 to be removed for repair or replacement without disrupting circulation of that respective color among its respective inlet and recirculation ports 14, 16 and source 18. Each valve member 26 is operated by an operator 37 housed in a chamber 38 provided in its respective module 12-1, 12-2, . . . 12-n. Each chamber 38 is coupled via a weep port 40 to an exterior surface 42 of its respective module 12-1, 12-2, . . . 12-n. The presence of that respective valve 26's color at the exterior surface 42 of its respective module 12-1, 12-2, . . . 12-n provides an indication that that respective valve 26 and/or operator 37 is malfunctioning and in need of repair or replacement.

Figure 1:
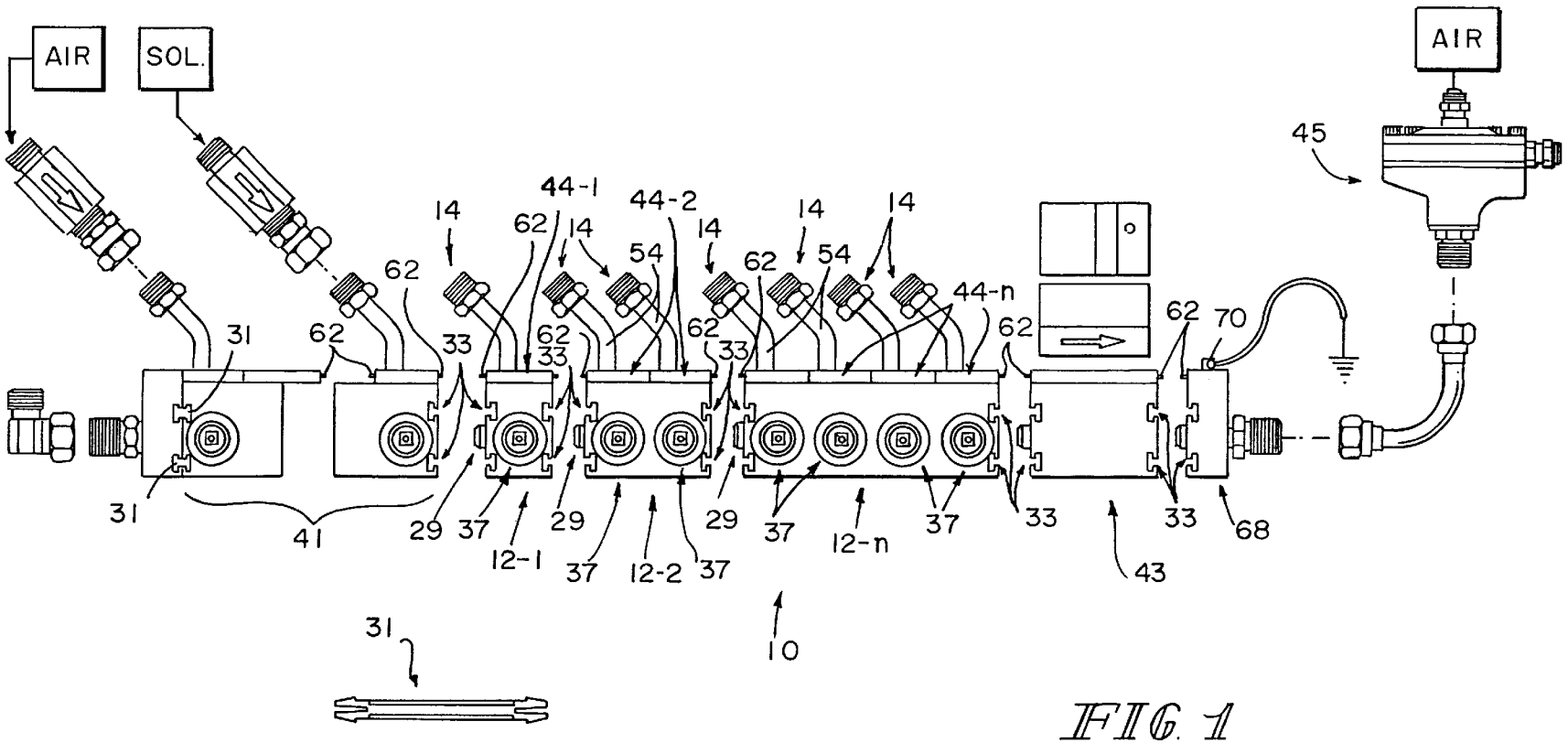
FIG. 1 illustrates a partially exploded side elevational view of a color changer constructed according to the present invention.

Typically, additional modules 41, 43, 45, FIGS. 1–2, are provided for such additional functions as, for example, flushing color from the dispensing equipment 30 and flushing the color changer 10 between color dispensing cycles (module 41), metering the flow of fluid from the color changer 10 (module 43), and regulating the pressure of the dispensed fluid (module 45), respectively. Typically, services such as higher pressure compressed air, lower pressure compressed air, solvent, and the like are provided to inlet ports of these additional modules 41, 43, 45.

Each module e 12-1, 12-2, . . . 12-n illustratively is constructed from an electrically non-conductive resin or polymer such as, for example, Acetron® GP acetal polymer. Each module 12-1, 12-2, . . . 12-n further includes one or more electrically non-insulative plates 44-1, 44-2, . . . 44-n, for example, stainless steel plates, coupled, for example, by cap screws 49, to surface 42 of each respective module 12-1, 12-2, . . . 12-n. FIGS. 1, 3 and 4. Couplers 54, 56, illustratively also constructed from metal, are press-fitted, soldered or otherwise attached to each plate 44 to permit access to ports 14, 16, respectively, through plate 44 to couple that respective module 12-1, 12-2, . . . 12-n in the appropriate number, two, four or eight in the illustrated example, of coating material color circulation circuits between that module 12-1, 12-2, . . . 12-n and respective coating material color sources. The conduits from the various coating material supplies and the return conduits to the various coating material sources 18 are coupled to respective couplers 54, 56.

Two opposite edges 60 of each plate 44 are provided with a mechanism for coupling the plates 44-1, 44-2, . . . 44-n together electrically. The illustrated coupling mechanism includes (a) pin(s) 62 which extend(s) from the edge 60 of each plate 44 into electrical contact in (a) socket(s) 64 provided for the pin(s) 62 on the next adjacent plate(s) 44. Each edge 60 can be provided with both (a) pin(s) 62 and (a) socket(s) 64. In this way, all of the plates 44 are coupled together electrically. During installation of the color changer 10, for example, onto a wall or support in a coating booth, onto an arm of a robot painter, or the like, grounding of the color changer 10 to the installation can then be accomplished by coupling a grounding strap or conductor, for example, a length of 12 gauge A. W. G. conductor, between any of the electrically coupled components of the color changer 10 and any electrically non-insulative component of the installation to which color changer 10 is to be grounded. In the illustrated embodiment, the downstream-most component of the color changer 10 is an electrically non-insulative, for example, stainless steel, plate 68 which is coupled to the downstream end of the flowmeter 43, illustratively by retaining clips 31. Plate 68 illustratively is also provided with(a) pin(s) 62 which extend(s) from plate 68 into electrical contact in (a) socket(s) 64 provided for the pin(s) 62 on flowmeter 43. Flowmeter 43 in turn illustratively is provided with (a) pin(s) 62 which extend(s) into electrical contact in (a) socket(s) 64 provided for the pin(s) 62 on the next adjacent plate 44. As with plates 44, the facing surfaces of plate 68 and flowmeter 43 can be provided with both one or more pins 62 and one or more sockets 64 to promote optimum electrical contact of the various electrically non-insulative components of the color changer 10. Plate 68 can also be provided with a connector 70 to facilitate coupling of a conductor to plate 68 and thence to the electrically non-insulative components of color changer 10.

What is claimed is:

1. A fluid type changer including multiple modules, each module including a body constructed from an electrically non-conductive material and a plate constructed from an electrically non-insulative material coupled to the body, each plate including at least one of a receptacle for receiving an electrically non-insulative contact and an electrically non-insulative contact oriented to be received in such a receptacle when the multiple modules are coupled together in a fluid type changer.

2. The apparatus of claim 1 wherein at least one of the modules includes a valve for selecting a fluid provided to that module for supply from the changer.

3. The apparatus of claim 2 further including a source for the selected fluid for coupling in a circuit with the at least one module, the at least one module including an input port for entry into the at least one module of the selected fluid from the source and a recirculation port for the recirculation of the selected fluid from the at least one module back to the source.

4. The apparatus of claim 3 further including an electrically non-insulative coupler for coupling the source of the selected fluid to the input port and an electrically non-insulative coupler for coupling the recirculation port to the source of the selected fluid, the couplers being electrically coupled to the plate on the at least one module.

5. The apparatus of claim 3 wherein the module includes an output port for the output of the selected fluid from the fluid type changer, selection of the valve permitting the selected fluid to flow from the input port to the output port.

6. The apparatus of claim 3 including a plurality of sources for respective selected fluids, a plurality of the modules including respective input ports for entry into the respective modules of respective fluids from respective sources and respective recirculation ports for the recirculation of the respective fluids the respective recirculation ports for the recirculation of the respective fluids from the respective modules back to the respective sources.

7. The apparatus of claim 6 further including electrically non-insulative couplers for coupling respective sources to respective input ports and electrically non-insulative couplers for coupling respective recirculation ports to respective sources, the couplers being electrically coupled to the plates on the respective modules, and electrically coupled together through the electrically non-insulative contacts and receptacles on the respective plates.

8. The apparatus of claim 1 wherein each plate includes a surface for orienting adjacent an adjacent surface of an adjacent plate, one of the adjacent surfaces including at least one of the contacts and the other of the adjacent surfaces including at least one of the receptacles for receiving the said one of the contacts.

9. The apparatus of claim 8 wherein each of the adjacent surfaces includes both at least one of the contacts and at least one of the receptacles.

10. A fluid type changer including a body constructed from an electrically non-conductive material and a plate constructed from an electrically non-insulative material coupled to the body, a source of fluid for coupling in a circuit with the body, the body including an input port for entry of the fluid from the source and a recirculation port for the recirculation of the fluid back to the source, an electrically non-insulative coupler for coupling the source of the fluid to the input port and an electrically non-insulative coupler for coupling the recirculation port to the source of the fluid, the couplers being electrically coupled to the plate.

11. The apparatus of claim 10 wherein the body includes a valve for controlling dispensing of the fluid from the changer to equipment coupled to the changer.

12. The apparatus of claim 11 wherein the body includes an output port for the output of the fluid from the changer, operation of the valve permitting the fluid to flow from the input port to the output port.

13. A fluid type changer including multiple modules, each including a body constructed from an electrically non-conductive material, each body including a valve for selecting a fluid provided to that module for supply from the changer, each module further including a plate constructed from an electrically non-insulative material coupled to its respective body, each plate including at least one of a receptacle for receiving an electrically non-insulative contact and an electrically non-insulative contact oriented to be received in such a receptacle when multiple modules are coupled together in a fluid type changer to couple the plates of the modules of the fluid type changer together electrically.

14. The apparatus of claim 13 wherein each plate includes a surface for orienting adjacent an adjacent surface of an adjacent plate, one of the adjacent surfaces including at least one of the contacts and the other of the adjacent surfaces including at least one of the receptacles for receiving the said one of the contacts.

15. The apparatus of claim 14 wherein each of the adjacent surfaces includes both at least one of the contacts and at least one of the receptacles.

16. The apparatus of claim 13 further including a source for each type of fluid provided to the changer, each respective source coupled in circuit with a respective module, each respective module including an input port for entry of a respective fluid from a respective source and a recirculation port for the recirculation of the respective fluid from the respective module back to the respective source.

17. The apparatus of claim 16 further including an electrically non-insulative coupler for coupling each source of fluid to the input port of a respective module and an electrically non-insulative coupler for coupling the recirculation port of a respective module to the respective fluid source, the couplers of each module being electrically coupled to the plate on that respective module.

18. The apparatus of claim 16 wherein each module includes an output port permitting the flow of a selected fluid from the fluid type changer, the output ports of the respective modules being coupled together.

19. The apparatus of claim 18 wherein the output ports of the respective modules are through ports, the through ports of the modules being aligned with each other to form a common passageway in the fluid type changer.

20. A method for maintaining components of a fluid type changer at substantially common electrical potential including providing multiple modules, each including a body constructed from an electrically non-conductive material, each body including a valve for selecting a fluid provided to that module for supply from the changer to equipment coupled to the changer, providing on each module a plate constructed from an electrically non-insulative material, providing on each plate at least one of a receptacle for receiving an electrically non-insulative contact and an electrically non-insulative contact oriented to be received in such a receptacle, and assembling the multiple modules together to couple the plates of the modules together electrically.

21. The method of claim 20 wherein providing on each module a plate constructed from an electrically non-insulative material includes providing on each plate a surface, providing on each plate at least one of a receptacle for receiving an electrically non-insulative contact and an electrically non-insulative contact oriented to be received in such a receptacle, and assembling the multiple modules together to couple the plates of the modules together electrically including providing on one of the adjacent surfaces at least one of the contacts and providing on the other of the adjacent surfaces at least one of the receptacles for receiving the said one of the contacts, orienting the surfaces of adjacent plates adjacent each other, and assembling the multiple modules together so that the at least one contact engages the at least one receptacle.

22. The method of claim 21 wherein providing on one of the adjacent surfaces at least one of the contacts and providing on the other of the adjacent surfaces at least one of the receptacles for receiving the said one of the contacts includes providing on each of the adjacent surfaces both at least one of the contacts and at least one of the receptacles.

23. The method of claim 20 further including coupling a source for each type of fluid in circuit with an input port of a respective module and a recirculation port of said respective module, and circulating the respective fluid between the source for the respective fluid and the respective module.

24. The method of claim 23 wherein coupling a source for each type of fluid in circuit with an input port of a respective module and a recirculation port of said respective module includes electrically coupling to the plate on that respective module an electrically non-insulative coupler for coupling each source of fluid to the input port of that respective module and an electrically non-insulative coupler for coupling the recirculation port of that respective module to the respective fluid source.

25. The method of claim 23 wherein providing multiple modules includes providing on each module an output port permitting the flow of a selected fluid from the fluid type changer, and assembling the multiple modules together in a fluid type changer includes assembling the multiple modules together with the output ports of the respective modules coupled together.

26. The method of claim 25 wherein providing on each module an output port permitting the flow of a selected fluid from the fluid type changer includes providing on each module a through port permitting the flow of a selected fluid from the fluid type changer, and assembling the multiple modules together with the output ports of the respective modules coupled together includes aligning the through ports of the modules with each other to form a common passageway in the fluid type changer.

* * * * *